United States Patent [19]

Mongeon

[11] 4,254,413

[45] Mar. 3, 1981

[54] E FIELD BALANCED PHASE INTRUSION ALARM

[75] Inventor: Ronald W. Mongeon, San Jose, Calif.

[73] Assignee: Stellar Systems, San Jose, Calif.

[21] Appl. No.: 45,055

[22] Filed: Jun. 4, 1979

[51] Int. Cl.[3] ..... G08B 13/26

[52] U.S. Cl. ..... 340/561; 340/564

[58] Field of Search ..... 340/561, 564; 325/29

[56] References Cited

U.S. PATENT DOCUMENTS

| | | | |
|---|---|---|---|
| 2,355,395 | 8/1944 | Rubenstein | 340/561 |
| 2,956,269 | 10/1960 | Schmidt | 340/564 |
| 2,971,184 | 2/1961 | Pearson et al. | 340/564 |
| 3,237,105 | 2/1966 | Kalmus | 325/29 |
| 3,375,511 | 3/1968 | Trimble et al. | 340/561 |
| 4,064,499 | 12/1977 | Geiszler et al. | 340/508 |

*Primary Examiner*—Glen R. Swann, III

*Attorney, Agent, or Firm*—Robert G. Slick

[57] ABSTRACT

An improvement in Instrusion Alarms of the type wherein a field wire acts as a transmitting antenna to produce an electric field and wherein a sense antenna is placed in the vicinity of the field wire to detect an intruder wherein at least one pair of field wires are employed at the extremities of a vertical configuration with sense wires between the field wires. The movement of a large object in the vicinity of such a system produces an equal perturbation on both of the sense wires so that no alarm is set off while an actual intrusion will cause a difference which is detected and utilized to provide an alarm system which is less susceptible to false alarms than the usual alarm systems.

5 Claims, 4 Drawing Figures

E FIELD BALANCED PHASE INTRUSION ALARM

SUMMARY OF THE INVENTION

The present invention relates to an improvement in intrusion alarms known as E field alarms and specifically relates to improvements on the intrusion alarms of U.s. Pat. Nos. 3,237,105 and 4,064,499, the subject matter of which is incorporated herein by reference.

In said patents, intrusion alarms are provided wherein a field wire acts as a transmitting antenna at a relatively low frequency to produce a quasi-stationary electric field. One or more sense antennas are placed in the vicinity of the field wire and connected to filtering and amplifying circuits leading to an alarm. In a practical embodiment of such an alarm, an AM detector is connected to the output of a preamplifier and the output is connected to a low-pass filter and to high gain amplifying means, including a band pass filter arrangement whereby the output of the high gain amplifier passes only signals within the relatively low frequency range associated with the movement of an intruder in the electric field created between the field wire and the sensing antenna.

Although this is a very satisfactory system, in some applications it may be subject to false triggering. For instance, such alarm systems are ordinarily placed in the vicinity of a fence and fence movements which might be caused by wind or other natural phenomena as well as lightning or other forms of electrical interference may cause a false alarm. Large "friendly" objects such as trucks can also cause a false alarm.

In accordance with the present invention, a system is provided which is much less susceptible to false alarms by providing at least one pair of field wires and at least one pair of sense wires. Each pair of sense wires is connected to opposite terminals of an input circuit for the alarm device in such a manner that if equal voltages of equal phase are developed on the two sense wires, there will be no output. Since both of the sense wires would normally be subject to the same electrical disturbances such as movements of an adjacent fence, trucks or lightning, such disturbances would not cause an alarm. On the other hand, in the case of an intruder, invariably a greater voltage would be developed on one of the sense wires than on the other setting off the alarm. Thus, the system would still remain sensitive to set off an alarm in the case of an intrusion but would be less susceptible to nuisance alarms.

DESCRIPTION OF THE PREFERRED EMBODIMENTS

Figure 1:
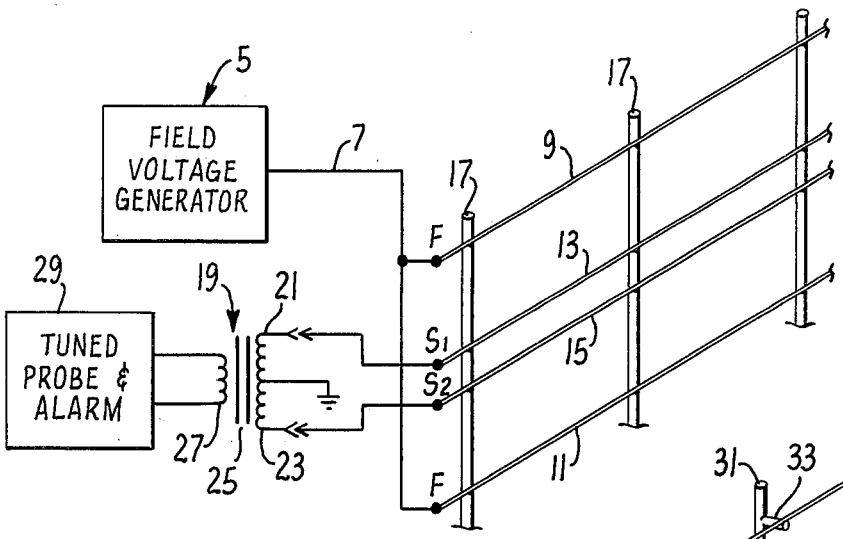
FIG. 1 is a simplified diagram showing how the present invention might be used as a free-standing perimeter security system.

In practical embodiments of the invention circuits would be included for sensing whether or not wires were open or short circuited. The alarm would include circuits to detect amplitude changes in the field, the rate of change and the time that the intruder is in the field pattern to fit the typical intruder profile. However, these various features of a practical circuit are well known to those skilled in the art and form no part of the present invention and therefore are not herein described.

Referring now to the drawings by reference characters, there is shown a field voltage generator 5 which may be identical with those parts identified as items 11, 12 and 23 in U.S. Pat. No. 4,064,499. The field voltage generator has an output line 7 which feeds an upper field wire 9 and a lower field wire 11. Running parallel to the field wires 9 and 11 are the sense wires 13 and 15. All of these wires are supported on the posts designated 17 and would be insulated from the posts.

The sense wire 13 is parallel to the field wire 9 and similarly, the field wire 11 is parallel to the sense wire 15. Sense wires 13 and 15 have output terminals designated S1 and S2 connected to opposite ends 21 and 23 of the primary transformer 19 having a grounded center tap. The transformer has effectively two primaries wound in the same direction on a common core 25. Although the two primary windings are shown for illustrative purposes at being a single center tapped winding, in a practical embodiment of the invention, the two primary windings may be separate. The secondary 27 is connected to the input terminals of a tuned probe and alarm circuit 29. Item 29 can be substantially identical with the items designated 14 through 22 of U.S. Pat. No. 4,064,499.

It is apparent that if equal voltages are induced on the sense lines 13 and 15 that there will be no output on the secondary 27; equal voltages of the same polarity and phase applied at opposite ends of the windings would oppose each other so that there would be no output. Thus, with a system such as this if the two sense wires are subjected to the same perturbation such as a large vehicle, lightning or electrical disturbance or the movement of an adjacent fence, no false alarm would be produced by the circuit. On the other hand, an intruder trying to climb over, under or through the security system would cause a greater disturbance on one sense wire than the other, causing an alarm to be set off.

Figure 2:
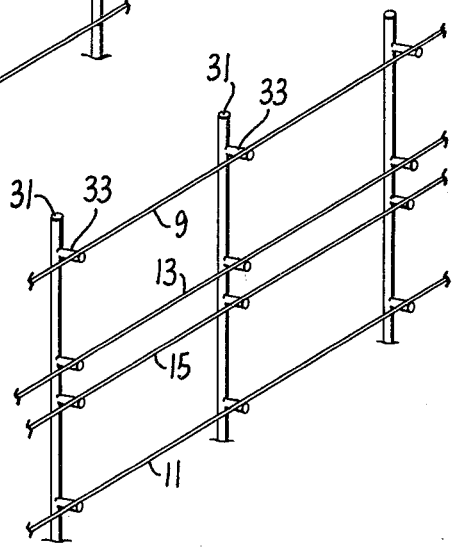
FIG. 2 is a fragamentary diagram, similar to FIG. 1, showing how the system of the present invention could be applied to an existing fence.

In FIG. 2, a somewhat similar installation is shown except here the installation is designed for use with an existing fence. Thus, with the existing fence posts 31 supporting a fence, not shown, one provides a plurality of standoff arms 33. These arms can advantageously be made of an insulating material such as fiberglas or they can be made of an conductive material with insulators at the ends. Standoffs 33 support the wires 9, 13, 15 and 11 in exactly the manner previously described.

Figure 3:
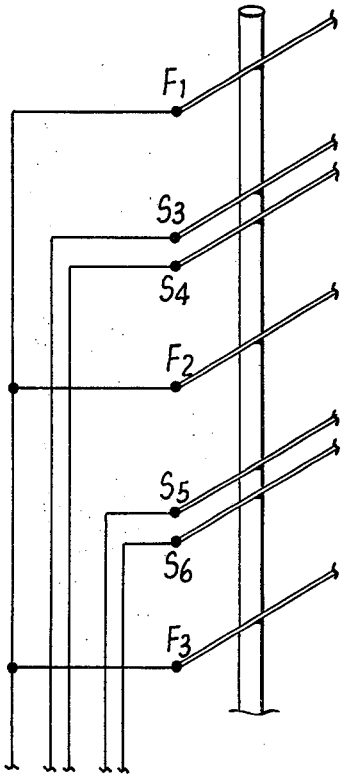
FIG. 3 is a fragmentary diagram of a curtain array system.

FIG. 3 shows how several field and sense wires can be combined to form a curtain array. Note that in the center of the array, field wire F2 serves two sense wires, namely S4 and S5.

Figure 4:
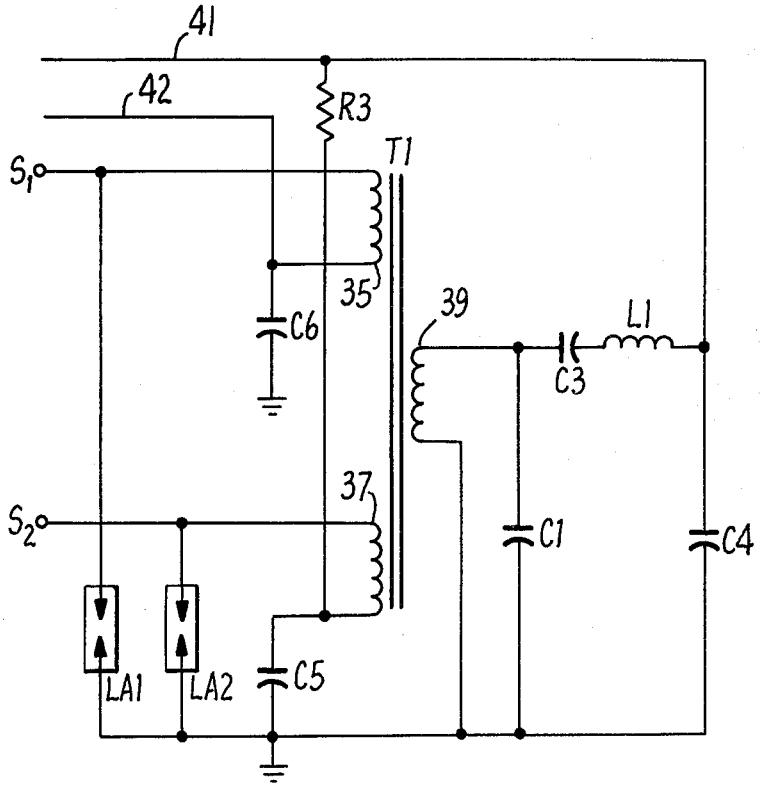
FIG. 4 is a schematic diagram showing a practical filtering and phasing circuit for carrying out the present invention.

In FIG. 4 a practical filter and probe circuit is shown. Here a transformer T1 is employed, having equal primary windings 35 and 37 and a secondary winding 39. In a practical embodiment of the invention, an ordinary telephone hybrid transformer was employed but it will be understood that the transformer is not critical so long as it is capable of handling the frequencies of the alarm circuit and also matching the impedances of the sensing circuit to the alarm circuit. The sensing wire S1 is attached to one side of the primary 35 while the sensing wire S2 is connected to the opposite terminal of the primary 37 so that voltages developed on S1 and S2 oppose each other. Both of the input lines are advantageously provided with lightning arresters LA1 and LA2. The opposite sides of the primary windings are grounded for AC through the capacitors C5 and C6. The output winding 39 of the transformer is connected to a filter C1, C3 and L1 tuned to the frequency of the field voltage generator. The output of the filter is bypassed to ground for stray RF fields through the capacitor C4. The output signal from the circuit is taken through line 41. R3 forms part of a DC supervisory circuit for detecting an open or short on sense wire S2. In a similar manner, line 42 serves to monitor for an open or short on sense wire S1. The circuit shown in FIG. 4 is substituted for the tuned probe circuit 14 of U.S. Pat. No. 4,064,499 and the output is passed to the preamplifier 15 of said patent so that the further processing of the signal is not herein described.

Although certain specific circuitry has been shown, it will be understood that this is for purposes of illustration only. For instance, instead of employing the transformer with the split primary, one can merely pass the output from the two sensing wires to the inverting and non-inverting inputs of a differential amplifier. Further, many other configurations can be employed rather than simple configurations shown.

I claim:

1. In an intruder alarm system wherein a field wire creates an electric field and a sense wire is provided parallel to said field wire and wherein a sensitive amplifying and filtering circuit detects perturbations on said sense wire resulting from the presence of an intruder intersecting the field between the field wire and the sense wire, the improvement comprising:

a. at least two field wires, said field wires being spaced from each other and running generally parallel to each other;

b. sense wires between said field wires for sensing the field created between each sense wire and each field wire, there being at least two sense wires, said sense wires being spaced from corresponding field wires whereby a common disturbance creates equal voltages on said sense wires, said sense wires being connected to a balanced circuit having an input leading to a filtering and detection system whereby equal voltages on said sense wires will counteract each other and said detection system is actuated only by unequal voltages developed in said two sense wires and;

c. said field and sense wires being arranged in a substantially vertical array.

2. The alarm system of claim 1 having one pair of spaced field wires and one pair of sense wires, said sense wires being located between said field wires.

3. The alarm system of claim 1 having at lease one field wire common to two sense wires.

4. The alarm system of claim 1 in the form of a vertical configuration with at least three spaced field wires and with sense wires located between said field wires.

5. The alarm system of claim 1 wherein the balanced circuit includes a transformer having two effective primaries and a secondary wherein sense wires are connected to said primaries in such a manner that voltages developed on said sense wires oppose each other whereby equal input voltages cause no output voltage on said secondary.

* * * * *